US008004167B2

(12) United States Patent
Ishida et al.

(10) Patent No.: US 8,004,167 B2
(45) Date of Patent: Aug. 23, 2011

(54) ELECTRON EMITTER AND A DISPLAY APPARATUS UTILIZING THE SAME

(75) Inventors: Takehisa Ishida, Singapore (SG); Wei Beng Ng, Singapore (SG)

(73) Assignee: Sony Corporation, Tokyo (JP)

( * ) Notice: Subject to any disclaimer, the term of this patent is extended or adjusted under 35 U.S.C. 154(b) by 259 days.

(21) Appl. No.: 11/892,250

(22) Filed: Aug. 21, 2007

(65) Prior Publication Data

US 2008/0067915 A1 Mar. 20, 2008

(30) Foreign Application Priority Data

Aug. 24, 2006 (SG) ..... 200605691-5

(51) Int. Cl.
*H01J 1/304* (2006.01)

(52) U.S. Cl. ..... 313/311; 313/497

(58) Field of Classification Search ..... 257/10; 313/309–311, 495–497
See application file for complete search history.

(56) References Cited

U.S. PATENT DOCUMENTS 5,949,184 A * 9/1999 Ohoshi et al. ..... 313/485
6,204,596 B1 * 3/2001 Macaulay et al. ..... 313/310
6,650,061 B1 * 11/2003 Urayama et al. ..... 315/169.3
2005/0067935 A1 * 3/2005 Lee et al. ..... 313/309
2005/0127351 A1 * 6/2005 Tolt ..... 257/10
2006/0043872 A1 * 3/2006 Jeong ..... 313/495
2006/0082283 A1 * 4/2006 Yotani et al. ..... 313/495

FOREIGN PATENT DOCUMENTS

KR 2002-017594 7/2002
KR 2003-0094490 12/2003

OTHER PUBLICATIONS

F. Maurer, et al., Nuclear Instruments and Methods in Physics Research B 245 (2006) 337-341.*
S. Ghosh, J. Raju and K. Dwivedi, Radiation Measurements 24 (1995) 171-176.*
Li et al., "Highly-ordered carbon nanotube arrays for electronics applications," 1999, Applied Physics Letters, vol. 75, No. 3, pp. 367-369.*
Austrian Patent Office Search Report issued in SG Application No. 200605691-5 dated Nov. 9, 2007.

* cited by examiner

*Primary Examiner* — Karabi Guharay
(74) *Attorney, Agent, or Firm* — Rader, Fishman & Grauer PLLC

(57) ABSTRACT

A field effect electron emitting apparatus using nano-wire electron emitters is disclosed where each nano-wire electron emitter may be grown in a pore of an insulating layer and/or may have at least a portion exposed from the pore. A method of manufacturing a field effect electron emitting apparatus is also disclosed. The field effect electron emitting apparatus may be used in a display.

20 Claims, 7 Drawing Sheets

ELECTRON EMITTER AND A DISPLAY APPARATUS UTILIZING THE SAME

This application is cross referenced to a related co-pending application filed on the same date titled "An electron emitter and a display apparatus utilizing the same", naming Takehisa Ishida as the inventor.

FIELD OF THE INVENTION

The present invention relates to an electron emitter and a display apparatus utilizing the same, particularly, though not exclusively, to a field effect electron emitting apparatus, a method of manufacturing a field effect electron emitting apparatus, a field effect display, and a method of manufacturing a field effect display.

BACKGROUND

Recently, flat panel displays (FPD) have become popular due to their smaller footprint and larger, flatter screens compared to conventional technology. For example, liquid crystal displays (LCD) and plasma display panels (PDP) are replacing cathode ray tubes (CRT) in many domestic applications. However, some types of FPD technology have disadvantages compared to conventional CRT technology. For example, LCDs have a slow response rate, which degrades the quality of fast-moving images and PDPs have a reduced life expectancy.

An alternative technology to LCD or PDP is a field emission display (FED). A typical FED incorporates a large array of fine metal tips or carbon nano-tubes (CNT), which emit electrons through a process known as field emission. Since a FED works based on a similar principle to a CRT, namely, an electron emitter and a phosphor, it gives a sufficient fast response rate. However, the fabrication of so-called Spindt-type emitters, which are utilized for most FED systems, requires complex processes and increase in the cost of FEDs.

Therefore, it would therefore be desirable to provide an emitter which has a fast response rate and/or a low production cost.

SUMMARY OF THE INVENTION

It is therefore an objective of at least one embodiment to provide an electron emitter that overcomes at least one of the above mentioned problems.

In general terms, in a first aspect, the invention proposes that in a field effect electron emitting apparatus using nano-wire electron emitters, each nano-wire electron emitter may be grown in a pore of an insulating layer. This may have the advantage that a simpler process, such as electrochemical plating, can be used in the fabrication process, thus reducing the production cost.

In a second, independent aspect, it is proposed that a portion of the insulating layer be removed, so that each nano-wire electron emitter may have at least a portion exposed from the pore. This may have the advantage that a simpler process, such as etching, can be used in the fabrication process, thus reducing the production cost.

In a first specific expression of the invention, there is provided a field effect electron emitting apparatus comprising;

a cathode;

an insulating layer on or adjacent to the cathode having an array of pores; and a grown nano-wire electron emitter in each pore, each nano-wire electron emitter connected to the cathode.

In a second specific expression of the invention, there is provided a field effect electron emitting apparatus comprising;

a cathode;

an insulating layer on or adjacent to the cathode having an array of pores;

a nano-wire electron emitter in each pore having at least a portion exposed from the pore, each nano-wire electron emitter connected to the cathode; and a gate electrode on or spaced parallel to the insulating layer.

In a third specific expression of the invention, there is provided a method of manufacturing a field effect electron emitting apparatus comprising;

providing a cathode;

providing an insulating layer having an array of pores on or adjacent to the cathode; and growing a nano-wire electron emitter in each pore, each nano-wire connected to the cathode.

In a forth specific expression of the invention there is provided a method of manufacturing a field effect electron emitting apparatus comprising;

providing a cathode;

providing an insulating layer having an array of pores on or adjacent to the cathode; and providing a nano-wire electron emitter in each pore having at least a portion exposed from the pore, each nano-wire electron emitter connected to the cathode.

In a fifth specific expression of the invention, there is provided a method of manufacturing a field effect display comprising;

providing a field effect electron emitting apparatus according to the method as claimed in any of the methods described above; and providing a phosphor coated screen on or spaced parallel to the field effect electron emitting apparatus.

In a sixth specific expression of the invention, there is provided a field effect display comprising;

a field effect electron emitting apparatus as described in any of the apparatuses above; and a phosphor coated screen on or spaced parallel to the field effect electron emitting apparatus.

BRIEF DESCRIPTION OF THE DRAWINGS

One or more example embodiments of the invention will now be described, with reference to the following figures, in which:

FIG. 3(*b*) is a cross section of an alternative example of the screen in FIG. 1;

DETAILED DESCRIPTION

Figure 1:
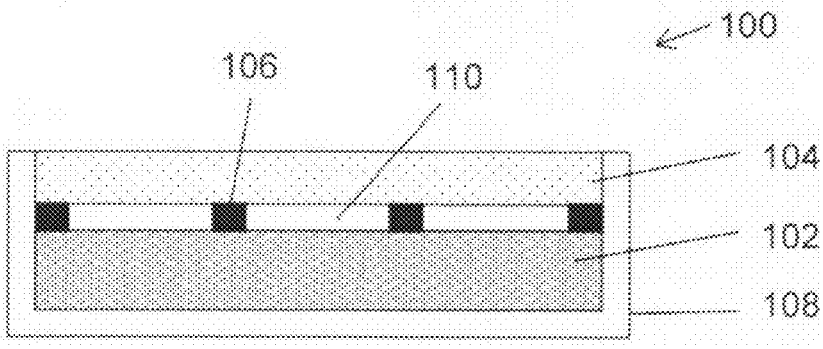
FIG. 1 is a cross section of a display apparatus according to an embodiment of the invention.

Referring to FIG. 1, a field emission display (FED) 100 is shown, including an emitter array 102 and a phosphor coated screen 104 in a housing 108. The phosphor coated screen 104 is spaced parallel to the emitter array 102 by a series of spacers 106. The accelerated electrons from the emitter array 102 collide against the phosphor coated screen 104, and fluorescent light is generated.

Figure 2:
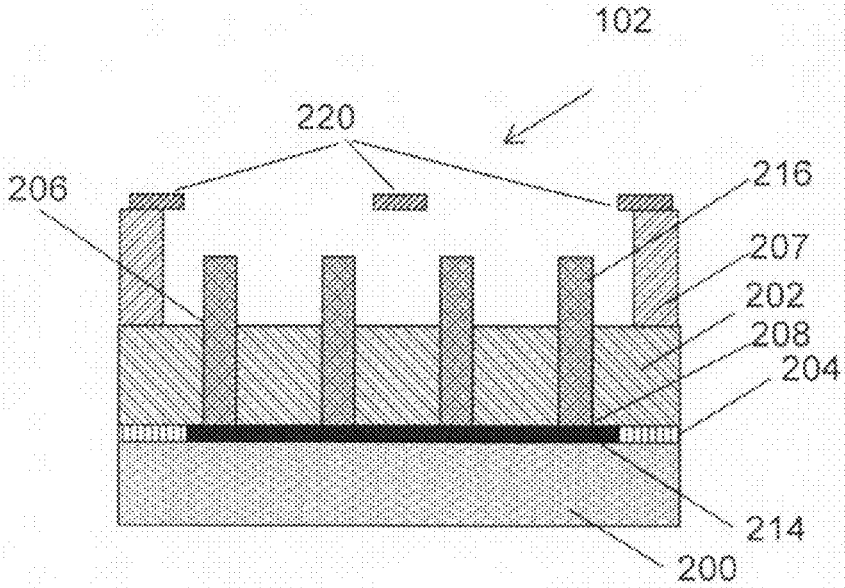
FIG. 2 is a cross section of an example of the emitter array in FIG. 1.

Referring now to FIG. 2, the emitter array 102 is shown in more detail. The emitter array includes a substrate 200, an insulating layer 202, a cathode(s) 214, nano-wire electron emitters 216 and a gate electrode(s) 220. The gate electrode may not be necessary in all applications, for example, as a back light for a LCD.

The substrate 200 is typically rectangular in shape and, for example, may be made from a sheet of glass typically 1 mm thick.

The insulating layer 202 is bonded to the substrate 200 by an adhesive 204, or otherwise deposited. The insulating layer 202 may be made of, for example, anodized aluminium oxide (AAO) or an etched track membrane (ETM). The insulating layer 202 has a substantially uniform array of pores, each pore 206 being of sufficient width to accommodate the nano-wire electron emitter 216. A pore density of more than $10^5/mm^2$, for example $10^6/mm^2$, may result in a good uniformity and a good luminous intensity.

The cathode 214 lies on the substrate and forms base 208 of each pore. The nano-wire electron emitter 216 has a portion in the pore and a portion exposed from the pore. The nano-wire electron emitter 216 is connected to the cathode 214 at the base 208. On top of the insulating layer 202 are spacers 207. The gate electrode 220 lies on top of the spacers 207.

The cathode 214 may be a series of strips that may be independently energised. Alternatively, the cathode 214 may simply be a single element. Each strip is typically rectangular in cross section and 100 nm in thickness. Each strip is provided with an external electrical connection at the edge of the substrate.

The spacers 207 may be at either end of the insulating layer 202, or at intermediate locations across the insulating layer 202. The spacers 207 ensure the distance between the gate electrode 220 and the nano-wire electron emitters 216 is kept constant. The gate electrode 220 may be either supported between adjacent spacers 207 or located on top of each spacer. Typically, the spacer is made from insulating material, such as a polymer.

The gate electrode 220 may be a series of strips that may be independently energised. Alternatively, the gate electrode 220 may simply be a single element. Each strip is typically rectangular in cross section and 100 μm in thickness. Each strip is provided with an external electrical connection at the edge of the insulating layer. Each strip has a uniform array of holes, which correspond to each pore or groups of pores in the insulating layer. Various combinations of size in cathode width, aperture of gate electrode, and anode are appropriate depending on the application.

The strips of the gate electrode may, for example, be arranged generally perpendicularly to the strips of the cathode. This patterning of the strips to intersect perpendicularly, also known as a passive matrix electrode configuration, enables the display of moving pictures. Thus, the emitter array is thereby divided into independently controllable pixels by the intersection of the strips. Each pixel may cover a plurality of emitters. To activate each pixel, the respective strip of the gate electrode is energised with a positive voltage with respect to the corresponding strip of the cathode.

Each nano-wire electron emitter 216 may be made of a conductive material, such as metal. Materials such as Co, Ni, Cr, Ag, Cu, W, Mo or Fe (or their oxides), which have a low work function, high conductivity, and a high melting point are suitable. Typically, the nano-wire is grown in situ (rather than being placed) by electrochemical plating. Typically, each nano-wire electron emitter 216 does not extend past the gate electrode. For example, each nano-wire electron emitter 216 may include a portion exposed from the pore, such as an exposed portion the length of the pore. Typically, the length of the exposed nano-wire is several micrometers. In the document, the term nano-wire is used to mean an elongate conductor less than 500 nm in width. Experiments carried out by the inventors indicate that a metal nano-wire less than 200 nm in diameter gives a reasonable threshold voltage.

Figure 3:
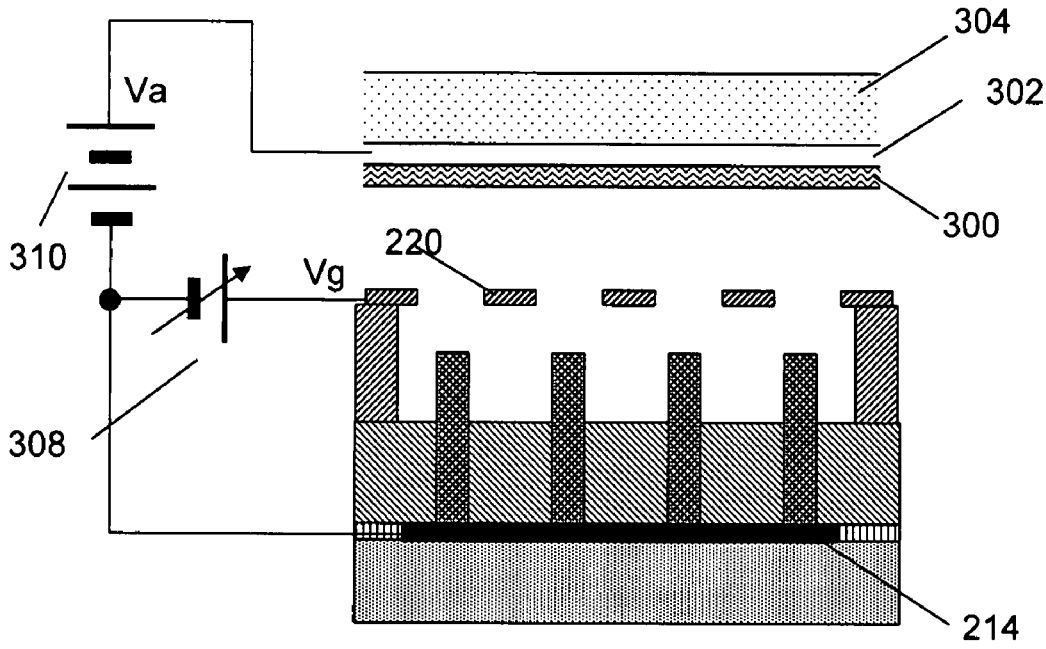
FIG. 3(*a*) is a cross section of an example of the screen in FIG. 1.
Figure 3:
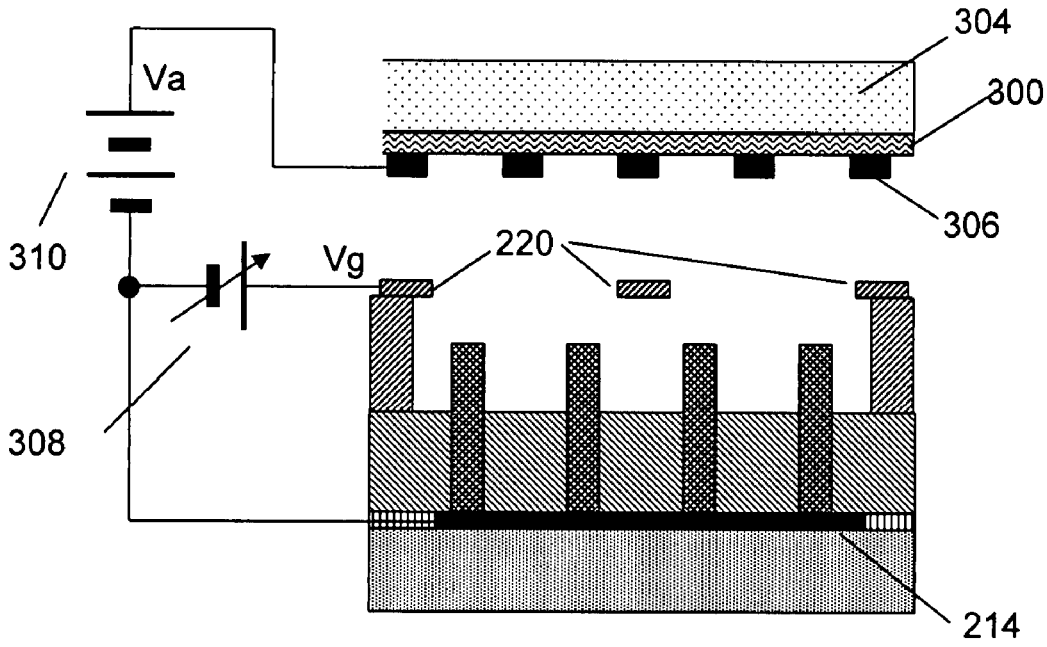

Referring now to FIG. 3(*a*) and FIG. 3(*b*), the phosphor coated screen 104 is shown in more detail. The phosphor coated screen 104 includes a phosphor layer(s) 300, an anode (s) 302 and a glass plate 304. As seen in FIG. 1, the distance between the phosphor screen 104 and the emitter array 102 is maintained by spacers 106. A cavity 110 in the housing 108, between the phosphor screen 104, the emitter array 102 and the spacers 106, is maintained as a vacuum, for example, $10^{-5}$ Pa.

The anode 302 may be a conductive transparent sheet, like electrode 302 between the phosphor layer 300 and the glass plate 304, as shown in FIG. 3(*a*). Alternatively, as seen in FIG. 3(*b*), the anode 302 may be a conductive grid-like electrode 306 between the phosphor layer 300 and the cavity 110. In a further alternative, the anode 302 can be coated between the phosphor layer 300 and the cavity 110. In this case, aluminum can be also utilized. The accelerated electrons penetrate the aluminum anode and collide against the phosphor layer 300. The aluminium anode between the phosphor layer 300 and the cavity 110 also acts as a reflective layer which enhances the generated light from the phosphor.

A voltage Vg is applied by a variable voltage source 308 between the cathode 214 and the gate electrode 220. The voltage between the cathode 214 and the anode 302 is kept at Va by a voltage source 310. The voltage Va is much higher than Vg.

In operation, Vg is applied between the gate electrode 220 and the cathode 214, so that the gate electrode has a positive potential and the cathode has a negative potential. The electron emitter 216, is electrically conductive, so the potential of the electron emitter 216 is equal to that of the cathode. The electric field concentrates on the tip of the electron emitter 216, and electrons are emitted from the tip of the electron emitter 216 and accelerated toward the gate electrode 220.

The phosphor coated screen 104 is energised at a higher potential than the gate electrode. The accelerated electrons collide against the phosphor, and fluorescent light is generated. By controlling the voltage Vg, the energy and/or density of the electron stream, and therefore the intensity of the fluorescent light, can be adjusted. This may be in terms of the average brightness of the display, or brightness of specific emitters or pixels as required in a display of dynamic images.

Method of Fabrication

Figure 4:
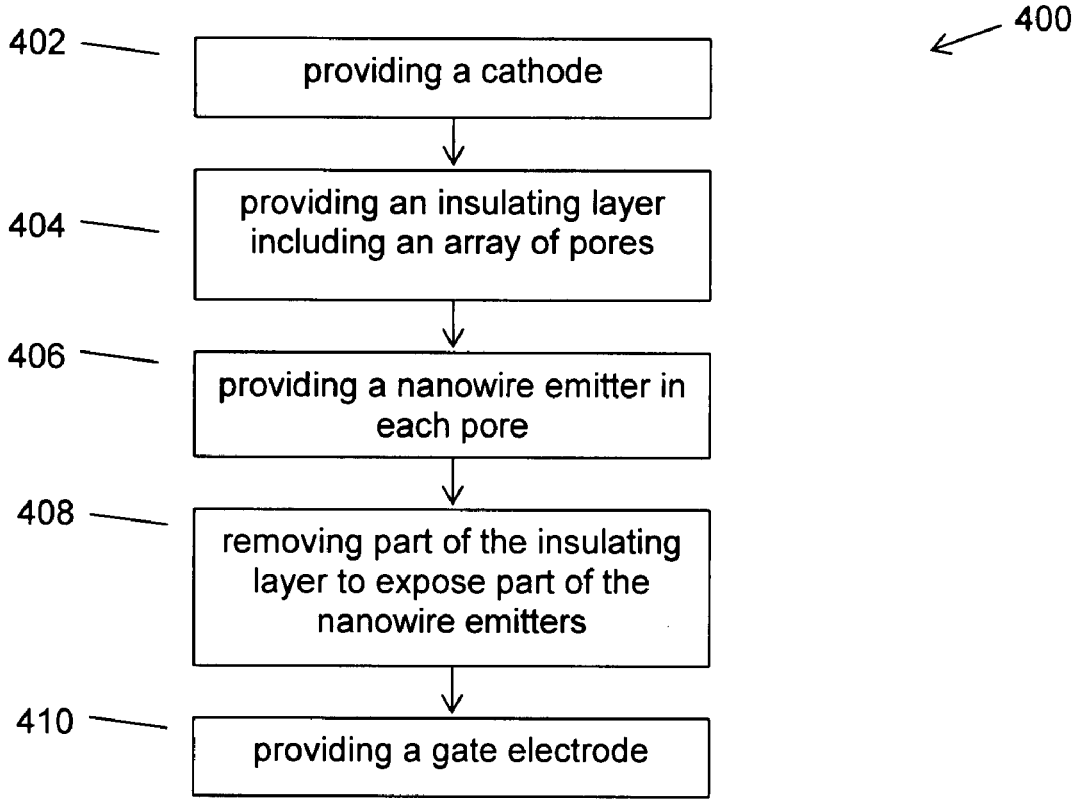
FIG. 4 is a flow chart of a fabrication process according to an embodiment of the invention.

Referring to FIG. 4, a method for fabricating an emitter array for a display is shown. In step 402, a cathode is provided. In step 404, an insulating layer including an array of pores is provided. In step 406, a nano-wire emitter is provided in each pore. In step 408, part of the insulting layer may be removed to expose part of the nano-wire emitters. In step 410, a gate electrode is provided. One skilled in the art will appreciate that the order listed is for example only, and method 400 could be implemented in other orders.

Figure 5:
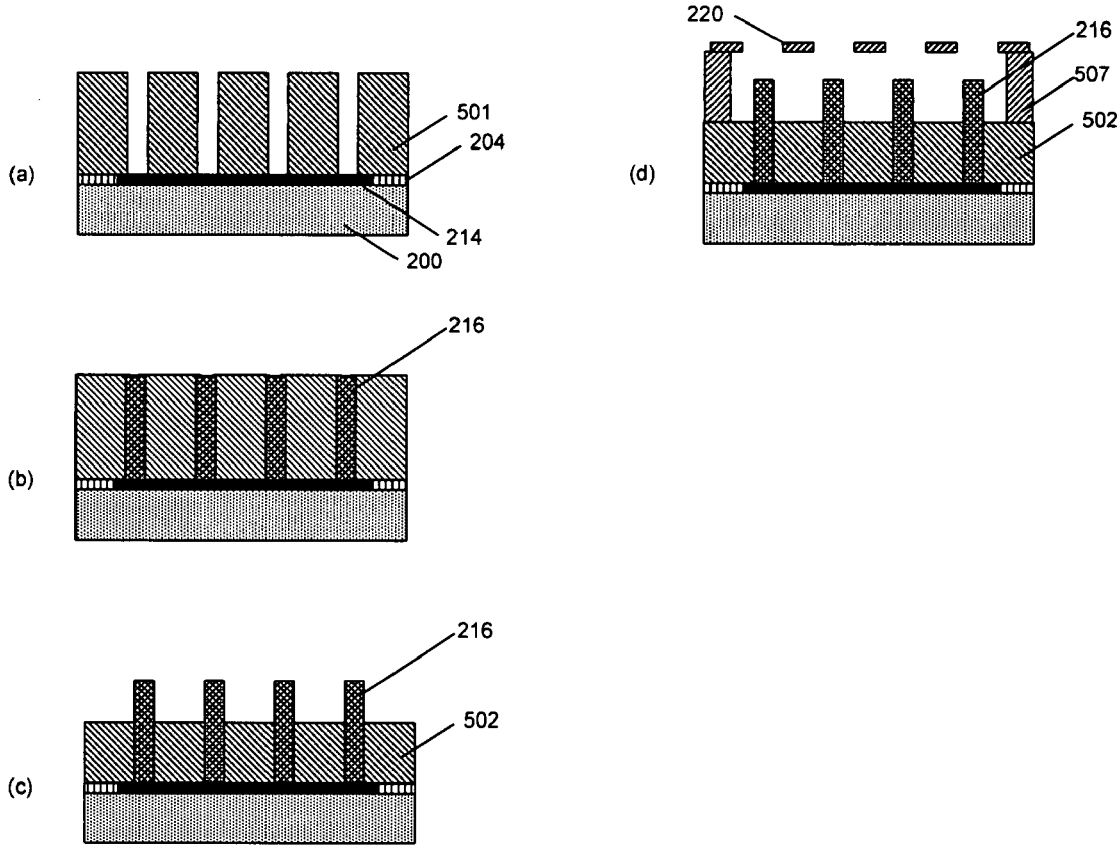
FIGS. 5(*a*) to 5(*d*) are schematics of an implementation of the fabrication process in FIG. 4.

FIG. 5 illustrates one example implementation of the method 400.

Step 402 may be implemented by depositing cathode 214 made of Cu, Au, Ni or Ti onto a rigid substrate 200, as seen in FIG. 5(*a*).

Step 404 may be implemented by bonding the insulating layer 501 on top of the cathode 214 by using an adhesive layer 204, as seen in FIG. 5(*a*).

A sheet of anodized aluminium oxide (AAO) is suitable for the insulating layer. AAO is formed by anodizing an aluminium sheet in acid. Pores are generated and self-assembled, like a lattice, and a honeycomb-like porous sheet is easily obtained without using a complicated photolithographic process. Furthermore, a pore density greater than $10^6/mm^2$ (which is impossible by photolithography) can be achieved. A higher emitter density gives more uniformity of electron irradiation. The pore density can be varied by selection of the anodizing conditions.

Alternatively, an Etched Track Membrane (ETM) is suitable for the insulating layer. The ETM may be formed in a two-step process. Firstly, a thin, plastic film (e.g., polycarbonate or polyester) is exposed to charged particles (e.g., ions of Se, Pb or Bi). As these particles pass through the plastic film, they create damage tracks, which consist of broken molecular bonds of the polymer. Therefore, the plastic film is partially weakened along the path that the particle travelled. The density of tracks is controlled primarily by the amount of time the film is exposed to the charged particles.

Secondly, the actual pores into the film are formed by an etching process. The tracks left by the atomic particles are etched by hot, caustic baths. The hot caustic etches the thin plastic film, dissolving away material from both sides. The areas where the charged particles passed through the film are dissolved many times quicker than the rest of the material where a charged particle did not pass. Thus, uniform, cylindrical and fine pores are created.

Step 406 may be implemented by growing a nano-wire 216 in each pore by electrochemical plating. The substrate and a counter electrode (e.g., a platinum wire) are put into a plating electrolyte (e.g., a mixed solution of 0.1 M boric acid $H_3BO_3$, 0.2 M Hydrated Copper Sulfate $CuSO_4$-$5H_2O$ and a small amount of surfactant) and a plating current is applied between the cathode and the counter electrode. Then, plated metal (e.g., copper) is deposited in the pores of the insulating layer, as seen in FIG. 5(*b*).

Step 408 may be implemented by etching the insulating layer by a solution (e.g. 6 M NaOH) and thinned down so that the plated nano-wires are partially exposed, as seen in FIG. 5(*c*). The length of the exposed metal is controlled by the depth of the etching. It is important that the etching process has to be stopped before the insulating layer is completely etched away. The remained insulating layer 502 plays an important role to support the nano-wires. This prevents nano-wires coming off. After etching, the exposed nano-wires may be annealed to be oxidised or to improve crystallinity, if it is necessary.

Step 410 may be implemented by placing spacers 507 above the nano-wire emitters 216 and placing the gate electrode 220 on the spacers 507, as seen in FIG. 5(*d*).

Figure 6:
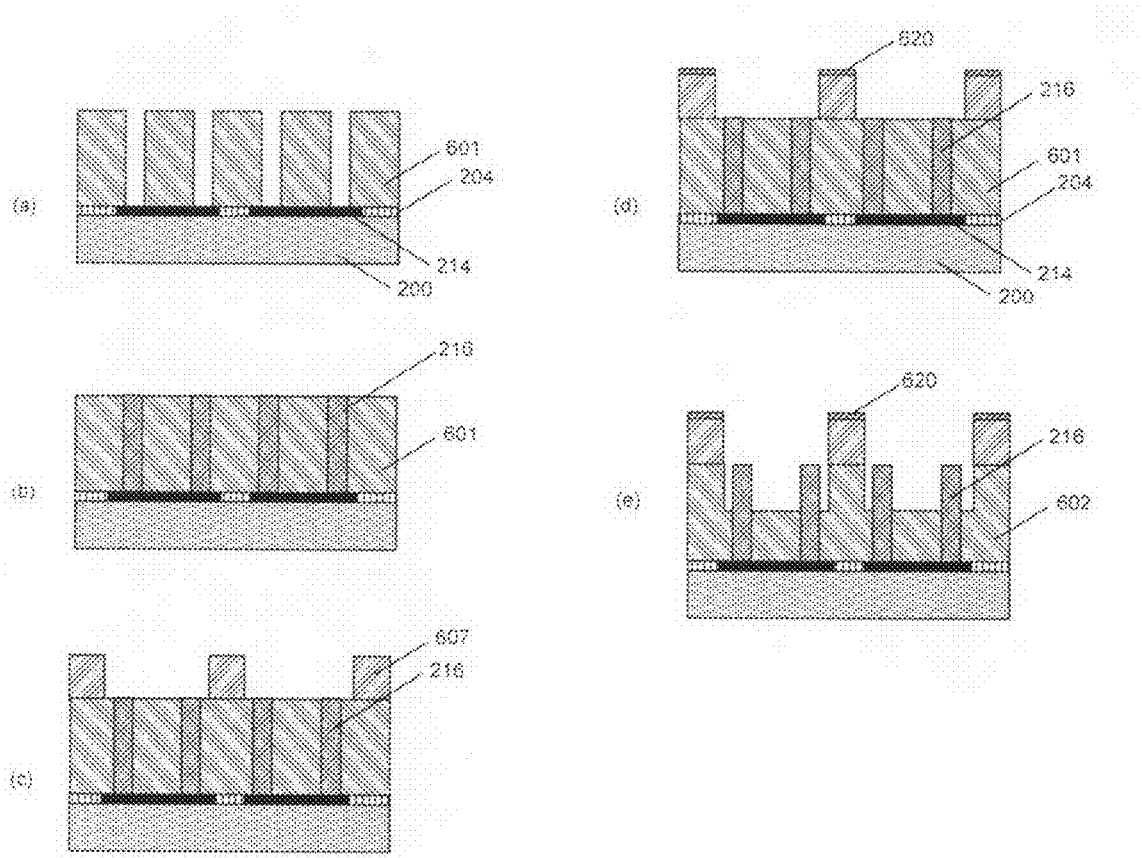
FIGS. 6(*a*) to 6(*e*) are schematics of an alternative implementation of the fabrication process in FIG. 4.

FIG. 6 illustrates an alternative example of the implementation of method 400.

Step 402 may be implemented by depositing a cathode 214 made of metal, such as Cu, Au, Ni or Ti, on a rigid substrate 200

Step 404 may be implemented by bonding the insulating layer 601 (using AAO or ETM as described above) on top of the cathode 214 by using an adhesive layer 204, as seen in FIG. 6(*a*).

Step 406 may be implemented by growing a conductive nano-wire 216 in each pore by electrochemical plating. The substrate and the counter electrode are put into a plating electrolyte, and a plating current is applied between the cathode and the counter electrode. Then, plated metal is deposited in the pores of the insulating layer as the nano-wire emitters, as seen in FIG. 6(*b*).

In this example, step 410 precedes step 408.

Step 410 may be implemented by screen printing a spacer layer 607 on the insulating layer 601, as seen in FIG. 6(*c*). The spacer layer 607 is made of an insulating material such as a polymer. A gate electrode 620 is deposited and patterned on top of the spacer layer 607 by screen printing or vacuum evaporation through a shadow mask, as seen in FIG. 6(*d*).

Step 408 may be implemented by etching and thinning down the insulating layer so that the nano-wires emitters 216 are partially exposed, as seen in FIG. 6(*e*). The exposed length of the nano-wire emitters 216 is controlled by the depth of the etching.

Figure 7:
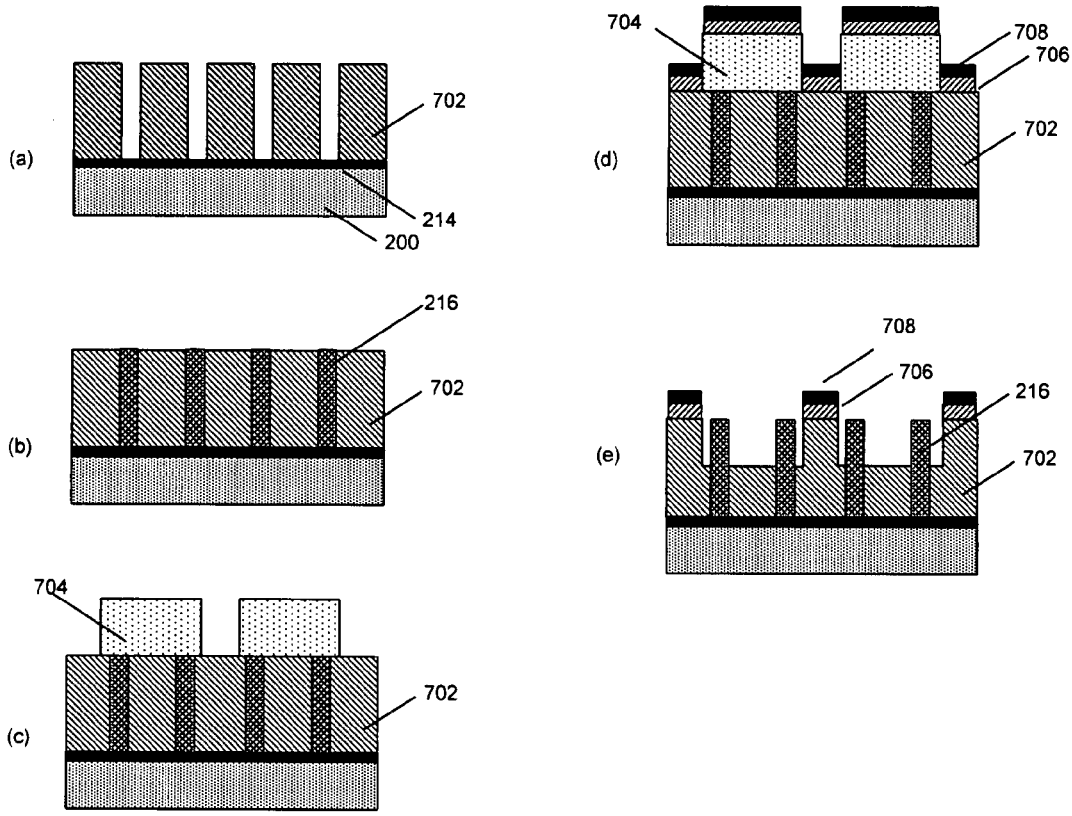
FIGS. 7(*a*) to 7(*e*) are schematics of a further alternative implementation of the fabrication process in FIG. 4.

FIG. 7 illustrates a further alternative example of implementation of the method 400.

Step 402 may be implemented by depositing the cathode 214 made of Cu, Au, Ni, Ti or other conductive material onto a rigid substrate 200, as seen in FIG. 7(*a*).

Step 404 may be implemented by bonding or depositing the insulating layer 702 on top of the cathode 214, as seen in FIG. 7(*a*).

Step 406 may be implemented by growing a nano-wire 216 in each pore of the insulating layer 702 by electrochemical plating, as seen in FIG. 7(*b*).

In this example, step 410 precedes step 408.

Step 410 may be implemented by placing a shadow mask 704 on the insulating layer 702, as seen in FIG. 7(*c*). A spacing layer 706 and subsequently a gate electrode 708 are deposited and patterned on top of the shadow mask 704 and the insulating layer 702 by vacuum evaporation, for example, as seen in FIG. 7(*d*).

After removing the shadow mask 704, step 408 may be implemented by etching and thinning down the insulating layer 702 so that the nano-wires emitters 216 are partially exposed, as seen in FIG. 7(*e*).

Figure 8:
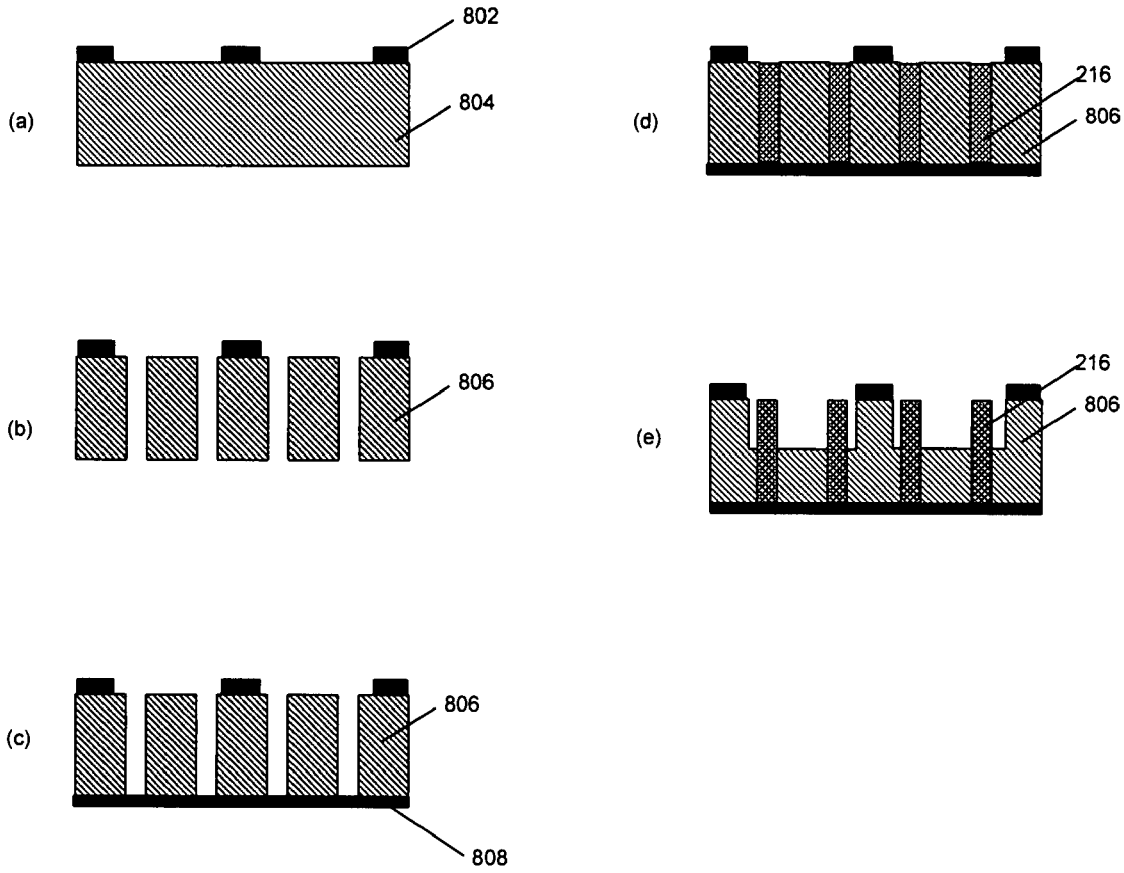
FIGS. 8(*a*) to 8(*e*) are schematics of a still further alternative implementation of the fabrication process in FIG. 4.

FIG. 8 illustrates a still further alternative example of the implementation of method 400.

In this example, the order of the steps is as follows: step 410; step 404; step 402; step 406; and then step 408.

Step 410 may be implemented by depositing and patterning gate electrode 802 on top of an aluminium sheet 804 by screen printing or vacuum evaporation through a shadow mask, as seen in FIG. 8(*a*).

Step 404 may be implemented by anodizing the aluminium sheet 804 in acid to form a sheet of anodized aluminium oxide (AAO) 806 suitable for the insulating layer. The array of pores is thereby formed in the insulating layer, as seen in FIG. 8(*b*).

Step 402 may be implemented by depositing a cathode 808 made of Cu, Au, Ni, Ti or other conductive material onto the bottom of insulating layer 806, as seen in FIG. 8(*c*).

Step 406 may be implemented by growing a nano-wire 216 in each pore by electrochemical deposition, as seen in FIG. 8(*d*).

Step 408 may be implemented by etching and thinning down the insulating layer 806 so that the nano-wires emitters 216 are partially exposed, as seen in FIG. 8(*e*). In this example, the height of each nano-wire is just short of the gate electrode. This may assist with emitting the electrons at a lower voltage.

The emitter array fabricated according to the above may then be installed into an housing, together with the spacers, an anode and a screen. Control electronics are provided to energize the cathode, the gate electrode, and the anode according to an input signal and/or stored instructions. Thus, each electron emitter can be selectively energised, and the energization can be varied to achieve the desired display. The skilled reader will also readily appreciate other applications for one or more of the embodiments, such as in a scanning electron microscope, a back-light of liquid crystal display, or a stepper for semiconductor production.

When inexpensive processes such as plating, etching and/or screen printing are used, the costs of production can be reduced.

When the gate electrode is used to control the intensity of the electrons emitted from each nano-wire, the response rate is fast enough to display a moving picture with good quality.

The invention claimed is:

1. A field effect electron emitting apparatus comprising:

a substrate;

a cathode on a surface of the substrate;

an insulating layer on the cathode having an array of pores;

a nano-wire electron emitter in each pore having at least a portion exposed from the pore and a portion connected to the cathode;

a gate electrode spaced parallel to the insulating layer; and a spacing layer between the insulating layer and the gate electrode, wherein each nano-wire electron emitter is an electrochemically plated metal or metal oxide nano-wire, wherein the exposed portion of the nano-wire electron emitter is a portion that is extended above a surface of the pore, and wherein the spacing layer that is between the insulating layer and the gate electrode spaces the gate electrode such that the gate electrode is at a distance to the insulating layer that is equal to or more than a distance of the surface of the pore to an end of the portion of the nano-wire electron emitter exposed from the pore.

2. The electron emitting apparatus as claimed in claim 1 wherein the insulating layer is anodized aluminum oxide.

3. The electron emitting apparatus as claimed in claim 1 wherein the insulating layer is an etched track membrane.

4. The electron emitting apparatus as claimed in claim 1 wherein the pore density of the array of pores is greater than $10^6/mm^2$.

5. The electron emitting apparatus as claimed in claim 1 wherein the average diameter of the nano-wire electron emitters is less than 500 nm.

6. The electron emitting apparatus as claimed in claim 1 wherein each nano-wire electron emitter has a tip being adjacent to the gate electrode.

7. A field effect display comprising a field effect electron emitting apparatus as claimed in claim 1, and a phosphor coated screen on or spaced parallel to the field effect electron emitting apparatus.

8. The electron emitting apparatus as claimed in claim 1 wherein the nano-wire electron emitter is a grown nano-wire electron emitter.

9. A method of manufacturing an field effect electron emitting apparatus comprising depositing a cathode on a surface of a substrate;

bonding an insulating layer having an array of pores on the cathode;

providing a nano-wire electron emitter in each pore such that at least a portion is exposed from the pore and a portion is connected to the cathode;

providing a gate electrode spaced parallel to the insulating layer, and providing a spacing layer between the insulating layer and the gate electrode;

wherein the nano-wire electron emitter is an electrochemically plating, wherein the exposed portion of the nano-wire electron emitter is a portion that is extended above a surface of the pore, and wherein the spacing layer that is between the insulating layer and the gate electrode spaces the gate electrode such that the gate electrode is at a distance to the insulating layer that is equal to or more than a distance of the surface of the pore to an end of the portion of the nano-wire electron emitter exposed from the pore.

10. The method as claimed in claim 9 wherein providing the space layer is screen printing the spacer layer on the insulating layer.

11. The method as claimed in claim 9 wherein each nano-wire electron emitter has a tip provided adjacent to the gate electrode.

12. The method as claimed in claim 9 wherein anodizing an aluminum sheet in acid to form anodized aluminum oxide (AAO) as the insulating layer.

13. The method as claimed in claim 12 wherein the anodizing conditions are selected to achieve a pore density of the array of pores greater than $10^6/mm^2$.

14. The method as claimed in claim 9 further comprising etching tracks in a membrane to form the insulating layer.

15. The method as claimed in claim 9 further comprising removing a portion of the insulating layer to expose a portion of the nano-wire electron emitter.

16. The method as claimed in claim 15 wherein the insulating layer is partially etched to expose a portion of the nano-wire electron emitter.

17. The method as claimed in claim 9 wherein the average diameter of the nano-wire emitters is less than 500 nm.

18. The method as claimed in claim 9 wherein the gate electrode has an array of apertures, and wherein each aperture corresponds to one or more pores.

19. A method of manufacturing a field effect display comprising providing an field effect electron emitting apparatus according to the method as claimed in claim 9, and providing a phosphor coated screen on or spaced parallel to the field effect electron emitting apparatus.

20. The method as claimed in claim 9 wherein providing a nano-wire electron emitter in each pore is growing the nano-wire electron emitter in each pore.

* * * * *